United States Patent [19]

Fischer

[11] Patent Number: 4,810,001

[45] Date of Patent: Mar. 7, 1989

[54] SKI

[75] Inventor: Josef Fischer, Ried im Innkreis, Austria

[73] Assignee: Fischer Gesellschaft mbH, Ried im Innkreis, Austria

[21] Appl. No.: 79,894

[22] Filed: Jul. 31, 1987

[30] Foreign Application Priority Data

Aug. 25, 1986 [AT] Austria ..... 2285/86

[51] Int. Cl.[4] ..... A63C 5/048

[52] U.S. Cl. ..... 280/608; 280/609; 280/610

[58] Field of Search ..... 280/608, 610, 609

[56] References Cited

U.S. PATENT DOCUMENTS

| | | | |
|---|---|---|---|
| 3,276,784 | 10/1966 | Anderson, Jr. | 280/610 |
| 3,501,161 | 3/1970 | Holmberg et al. | 280/610 |
| 3,893,681 | 7/1975 | Manning | 280/610 |
| 4,068,861 | 1/1978 | Zemke, Jr. | 280/608 |
| 4,233,098 | 11/1980 | Urbain | 280/608 |
| 4,259,274 | 3/1981 | Tiitola | 280/610 |

FOREIGN PATENT DOCUMENTS

| | | | |
|---|---|---|---|
| 359887 | 4/1980 | Austria . | |
| 416814 | of 1984 | Austria . | |
| 379314 | 2/1984 | Austria . | |
| 3105/85 | 3/1985 | Austria . | |
| 379956 | 8/1985 | Austria . | |
| 590112 | 6/1932 | Fed. Rep. of Germany | 280/608 |
| 3414440 | 10/1985 | Fed. Rep. of Germany | 280/610 |

*Primary Examiner*—David M. Mitchell
*Assistant Examiner*—Eric D. Culbreth
*Attorney, Agent, or Firm*—Fleit, Jacobson, Cohn & Price

[57] ABSTRACT

In a ski of conventional structure, e.g. comprising a running surface, lower web core and upper web as well as steel edges of L-shaped cross section on the side of the ski running surface, the steel edges (8) have been adhesively inserted into a groove (7) provided for in the semi-manufactured ski by means of their respective limbs (8*a*) extending horizontally in respect of the running surface. This groove (7) is milled into the semi-manufactured ski prior to the insertion of the steel edge.

12 Claims, 2 Drawing Sheets

SKI

BACKGROUND OF THE INVENTION AND DISCUSSION OF PRIOR ART

The invention relates to a ski of conventional structure, e.g. comprising a running surface, a lower web, a core and an upper web, which ski on the running surface side comprises steel edges of L-shaped cross section, the steel edges having been subsequently bonded adhesively with their limbs which are horizontal to the running surface each into a respective groove previously provided for in the partly manufactured ski.

The invention also relates to a process for the manufacture of such ski.

According to the most recent state of the art, skis of that type have been predominantly manufactured in that the ski components including the steel edges were assembled with an interlayer of a bonding agent in curing moulds, the bonding agent then being cured with pressure and heat in order to bond the ski components together. The different properties of the steel edges and the remaining ski components in respect of module of elasticity, thermal expansion as well as installation tolerances bring about a high scatter in respect of geometry of the skis, i.e. the prestressing of the skis, the planeness of the running surface and upper surface and the mechanical properties.

A partly manufactured ski is known from AT-PS 359 887 in which the core, the upper portion and the lower portion are so cut to size that after the components have been bonded together, there is already present a groove for the accommodation of the steel edges. However, without the use of the insert member during the bonding of the running surface member, a narrow groove is formed which is unsuitable for the insertion of a steel edge. A constant groove geometry which is suitable for the bonding insertion of the steel edge is only attained by subsequent milling of the groove.

OBJECTS AND GENERAL DESCRIPTION OF THE INVENTION

It is an object of the present invention to provide a ski which whilst avoiding the aforesaid drawbacks of known skis, has an accurately defined geometry for the accommodation of the steel edge without the need for subsequent milling of the groove.

This object is attained in that in a ski of the type referred to in the introduction, according to the invention the groove serving for the subsequent accommodation of the steel edge is milled into the partly manufactured ski prior to the insertion of the steel edge. Due to the subsequent installation of the steel edges, warping in particular, resulting from differences in thermal expansion coefficients between the steel edges and the plastics component is avoided.

For manufacturing this ski, the process according to the inventionprovides that the ski components with the exception of the steel edges are bonded together to form a plate which constitutes a partly manufactured ski or from which at least a partially manufactured ski is produced, the sides of which are shaped and whereafter optionally the side cheeks are shaped, lateral grooves being formed in the partly manufactured ski during or after this shaping procedure or such shaping procedures, into which grooves steel edges of L-shaped cross section are adhesively bonded by way of their limbs which are parallel to the running surface.

According to a further feature of the invention, a plate is moulded from the ski components, its width being greater than that of the ski and its length corresponding at least to the length of a ski from the ground contact region of the tip to the ground contact region of the ski end, whereafter the plate is cuct into the desired partly manufactured skis. This process permits the avoidance of installation tolerances. The shaping of the sides and side cheeks of the partly manufactured ski as well as the formation of the grooves for the steel edges may for example be brought about by milling. The constructional components may for example be made of a variety of materials such as aluminium, steel, wood, paper, fibre reinforced plastics, thermoplastics and many others.

The shaping, respectively milling procedure or the shaping, respectively milling procedures, as the case may be, of the partly manufactured ski produced from a sheet permits or permit the maintenance of substantially more accurate tolerances than the insertion tolerances for the ski. The side shaping or milling of the partly manufactured ski proceeds according to a further feature of the invention in such a manner that the lowermost cover layer, including the ski components there below, project beyond both sides of the core.

The further processing of the partly manufactured ski, once it has, where applicable, been fitted with steel edges may proceed according to a process which forms the subject of Austrian Patent Application A 3105/85. According to that process, the ski jointly with the steel edges, where appropriate, or respectively the running surface facing outwardly or respectively upwardly is inserted into a mould, the interior of which flares upwardly in a trough-shaped manner such that above the steel edges respectively laterally projecting parts around the core and the cover plate an approximately U-shaped empty cavity remains which is filled with plastics.

Finally, according to a further feature of the invention, the space to be filled with plastics may be evacuated before or during the introduction of the plastics, the suctional withdrawal of the air and the introduction of the plastics preferably taking place from opposite sides of the ski, preferably from opposite ends.

BRIEF DESCRIPTION OF THE DRAWINGS

The invention will be further described with reference to the drawing in which embodiments of the subject of the invention are illustrated.

DESCRIPTION OF EXAMPLES

Figure 1:
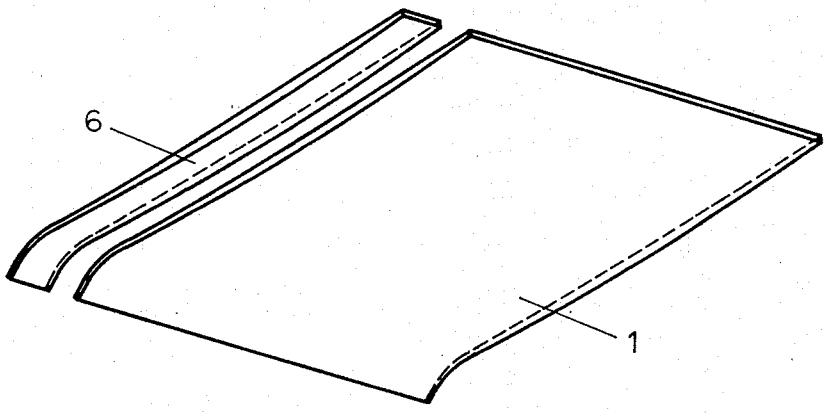
FIG. 1 shows the plate from which the partly manufactured skis are cut, FIG. 2, the partly manufactured ski, FIG. 3, the lateral shaping of the ski, FIG. 4, the milling of the groove, FIG. 5, the insertion of the steel edges, FIG. 6, the covering of the ski with a plastics layer and FIG. 7, a reversed plan view of the ski in its tip and rear regions.

The plate 1 illustrated in FIG. 1 comprising the core, laminating layers, webs etc. but without the steel edges, may be bonded together in an autoclave or pressed together in a press after all components prior to insertion into the press have been coated with an adhesive. Thus, the plate components may be subjected to thermal and pressure treatment after the insertion of adhesive films or prepreg layers, whereby the adhesive films or prepreg layers are cured to completion.

For the manufacture of the plate it is also possible to employ the socalled vacuum process according to Austrian patents 379 314, 379 956 and Austrian patent application A 416/84 wherein the components are inserted into a tool which is then closed in an airtight manner, air being withdrawn from opposite sides and binder being introduced.

Figure 2:
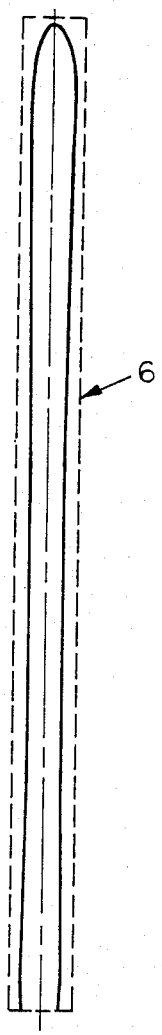
Figure 3:
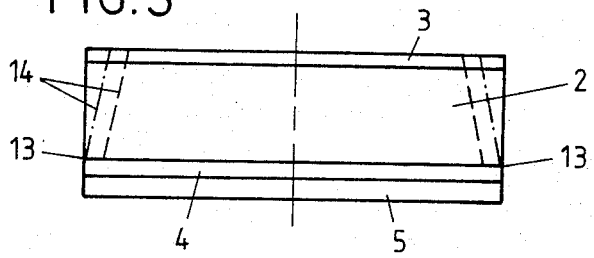
Figure 4:
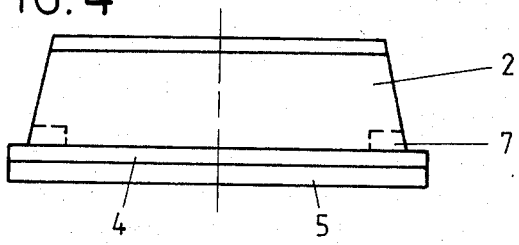
Figure 5:
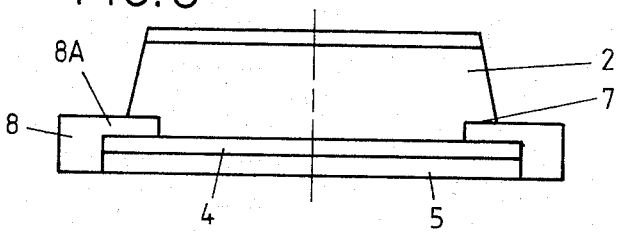

The width of the plate 1 corresponds to the total length of the ski and the length to a multiple of the width of the latter. For the sake of simplicity a plate 1 has been selected which as shown in FIG. 3 comprises a core 2, an upper web 3, a lower web 4 and a running surface 5. As indicated in FIG. 1, the partly manufactured skis 6 are cut from that plate 1 and are laterally shaped by milling as shown in FIG. 2, such that the partly manufactured ski, as shown in FIG. 3, attains a substantially rectangular shape. Thereafter the lateral surfaces of the partly manufactured ski are milled to taper in an upward direction as indicated in broken lines in FIG. 3, such that the lower web 4 and the running surface 5 extends laterally beyond the ski core 2.

However, it is also possible to form the taper of the side walls such that this incline 14, as shown in dash-dotted lines, terminates in the region of the upper edge 13 of the lower load-bearing web 4 respectively of the lower load-bearing webs.

Subsequently thereto, grooves 7 for the insertion of L-shaped steel edges 8 are milled alongside the load-bearing web 4 into the core 2, the steel edges then being bonded adhesively into the grooves 7 by means of their horizontal limbs 8a. As compared with the previously known process for the application of steel edges, the milling of a lateral groove for the insertion of the steel edge offers the further advantage of a more exact positioning of the groove in relation to the running surface, a saving of grinding procedures and a lower thermal loading of the running surface. The steel edges to be bonded in adhesively are now positioned accurately in relation to the centre line of the ski and in respect of the position of the running surface.

If one considers that the ski in its unloaded state is upwardly arched and is bent upwardly in opposition to such arching at its tip and at the rear end, it will in the unloaded condition bear against the ground only in the region adjoining the tip and in the region adjoining the rear end.

Figure 6:
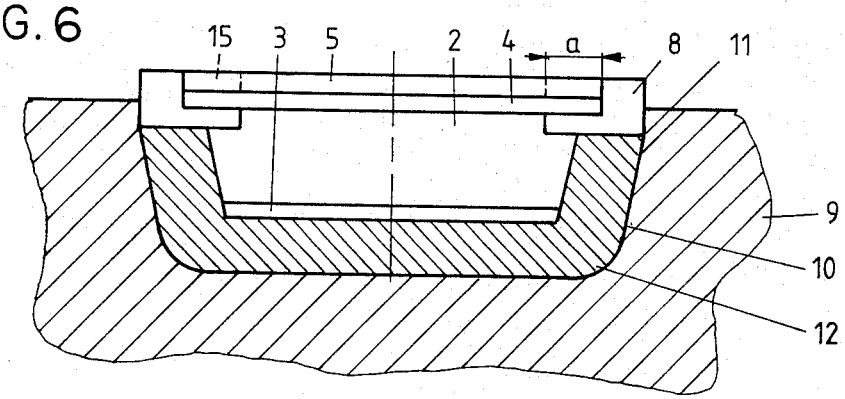

Preferably the steel edges 8 are inserted into the ski profile in a length in which the steel edges 8 do not project beyond the front and the rear regions of ground contact of the ski or only up to about 2 cm from the ski rear end, respectively up to about 10 cm in the direction towards the ski tip. Correspondingly also the groove 7 for the steel edges 8 is only milled out in that region of the core 2 in which the steel edges 8 are inserted. The terminal region of this groove 7 is denoted as 7A in FIG. 7. In succession to the groove 7 the edge of the running surface 5 is rebated to an extent corresponding approximately to the inner width "a" of the limb 8a, such that as indicated in broken lines in FIG. 6, a step-shaped recess 15 is formed. The same recess is also provided for at the heel end where it is denoted as 15'. If pressing of the ski components to form a plate, including the running surface or of the partly manufactured ski, including the running surface takes place after the rebate 15 has been cut out, a moulded body is inserted into the rebate 15 which fills the cutaway portion and which after pressing, drops off to release the rebate 15.

Figure 7:
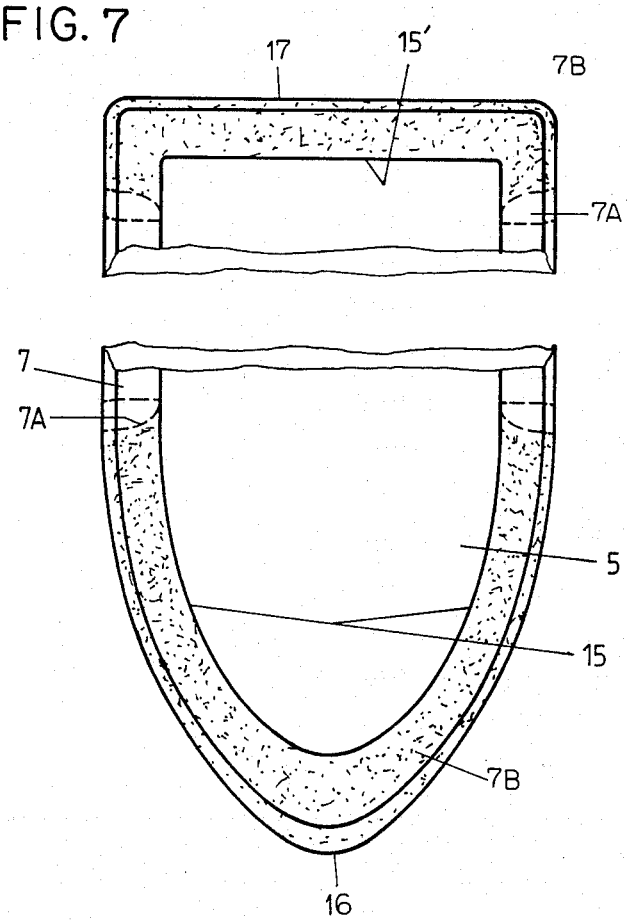

After the bonding insertion of the steel edges, the so produced partly manufactured ski is so inserted into a mould 9, the cavity 10 of which flares upwardly, with the steel edges 8 upwardly directed, that the partly manufactured ski with its steel edges finds support against the inclined side walls of the cavity 10 whereby an upwardly flaring trough-shaped cavity 12 is formed around the ski core 2 and the upper web 3, closed off by the supporting edge 11 of the steel edges 8, which cavity is filled with plastics which also fills the aforementioned cavity of the rebate 15 previously occupied by the aforementioned shaped bodies at the ski tip and the ski rear end and which is shown in dotted lines in FIG. 7. If the ends as well of the bonded-in limbs of the steel edges 8 have been exposed on the running surface side, the plastics also covers those ends whereby fixation of the steel edges is improved.

It stands to reason that within the scope of the invention, various design and process modifications are possible. For example, it is possible to carry out in a different sequence the process steps which are applied to the semi-manufactured skis 6 cut off the plate 1. It is furthermore possible to produce the semi-manufactured articles only up to the length between the two regions of ground contact of the ski or between the ski rear end and the front area of contact and to attach the ski tip 16 and where appropriate also the rear end 17 of the ski at a later stage, e.g. prior to insertion into the mould 9 or after the removal of the ski portion from the mould. Furthermore, it is possible to manufacture the plate 1 only in a width corresponding to that of a ski or only slightly wider.

Finally, there exists the possibility that the groove 7 for the steel edges 8 is milled around the entire lateral circumferential area of the ski to provide a groove portion 7B and making it possible to insert in closely fitting relationship to the respective ends of the steel edges moulded bodies which continue in the direction of the steel edges, which pass around the ski tip or the ski rear end and which terminate in closely fitting relationship at the respective opposite steel edge end. The moulded bodies are so designed that they do not become bonded to the remainder of the ski body during the adhesive bonding procedure and can be removed readily after the completion thereof.

The aforegoing examples should be read in conjunction with the preceding general description and the claims filed herewith which are part of the present disclosure. The person skilled in the art will be able to practice the invention as defined in the claims on the basis of the disclosure read as a whole.

What we claim is:

1. A process for manufacturing a ski of laminated structure, comprising the steps of:

providing a partly manufactured ski comprising a core, an upper web, a lower web and a running surface laminated together such that such core is disposed between said upper web and said lower web and said lower web is disposed between said core and said running surface;

milling two longitudinally extending groove portions in opposite lateral sides of said partly manufactured ski, each grooe portion being milled in a lateral side of said core immediately above an upper surface of said lower web such that each groove portion is defined by a portion of the upper surface of said lower web and a milled portion of said core;

providing two steel edges, each of said edges having an L-shaped cross section with a first leg and a second leg extending perpendicular to said first leg; and then adhesively bonding one of said steel edges into each of said groove portions such that said first legs of said steel edges extend parallel to said running surface and said second legs extend downwardly therefrom along the lateral sides of said partly manufactured ski.

2. A process of claim 1, wherein said partly manufactured ski comprises a ski tip at one longitudinal end thereof and a ski rear end at the opposite longitudinal end thereof, and said process comprises the step of milling a continuous groove in the core of the partly manufactured ski immediately above the lower web to form said two longitudinally extending groove portions, said continuous groove extending around the entire periphery of said partly manufactured ski including the ski tip and the ski rear end.

3. A process of claim 1, further comprising the step of covering an upper surface and lateral sides of said partly manufactured ski above said steel edges with a plastic material to form a single piece, integral layer having a U-shaped cross section.

4. A process of claim 1, comprising the step of forming a partly manufactured ski by bonding said core, upper web, lower web and running surface together to form a plate, shaping the lateral sides of said plate, and further shaping the lateral sides of said plate above said lower web to form a side cheek region on each lateral side of said partly manufactured ski.

5. A process of claim 4, wherein said two longitudinally extending groove portions are milled in opposite lateral sides of said partly manufactured ski after the lateral sides of the plate are shaped and the side cheek regions are formed.

6. A process of claim 4, wherein said two longitudinally extending groove portions are formed during shaping of the lateral sides of the partly manufactured ski.

7. A process of claim 4, wherein a ski tip and a ski rear end are fixed to opposite longitudinal ends of said partly manufactured ski after said core, upper web, lower web and running surface are bonded together.

8. A process of claim 4, wherein said longitudinally extending groove portions are longer than said steel edges and said process further comprises removably inserting molded bodies into the portions of said longitudinally extending groove portions which extend beyond said steel edges.

9. A process of claim 8, wherein said partly manufactured ski comprises a ski tip at one longitudinal end thereof and a ski rear end at the opposite longitudinal end thereof, and comprising the step of milling a continuous groove in the core of the partly manufactured ski immediately above the lower web to form said two longitudinally extending grooves portions, said groove extending around the entire periphery of said partly manufactured ski including the ski tip and the ski rear end, and further comprising removably inserting said molded bodies in the continuous groove at the ski tip and the ski rear end.

10. A process according to claim 8, further comprising the step of inserting the partly manufactured ski fitted with steel edges into a mold having a trough-shaped cavity, said partly manufactured ski fitted with the steel edges being inserted into said mold with the steel edges facing outwardly such that a peripheral cavity defined by an upper surface of the first legs of the steel edges and the trough-shaped cavity of the mold is formed, and then filling said peripheral cavity with a plastic material.

11. A process according to claim 10, wherein said peripheral cavity is evacuated prior to or during the introduction of said plastic material.

12. A process according to claim 10, wherein said molded bodies are removed from said longitudinal groove portions prior to inserting said partly manufactured ski fitted with the steel edges into said mold so that said plastic material fills said groove portions up to and against the ends of said steel edges.

* * * * *